US005253490A

United States Patent [19]

Doganay

[11] Patent Number: 5,253,490

[45] Date of Patent: Oct. 19, 1993

[54] HINGED INSERT RING

[76] Inventor: Mark Doganay, 47-19 39th Pl., Sunnyside, N.Y. 11104

[21] Appl. No.: 878,238

[22] Filed: May 4, 1992

[51] Int. Cl.[5] ..... A44C 9/00

[52] U.S. Cl. ..... 63/15.4; 63/15

[58] Field of Search ..... 63/15-15.8

[56] References Cited

U.S. PATENT DOCUMENTS

| | | | |
|---|---|---|---|
| 211,558 | 6/1879 | Edwards | 63/15.3 |
| 1,596,642 | 8/1926 | Weber | 63/15.4 |
| 2,177,314 | 10/1939 | Von Dachenhausen | 63/15.4 |
| 3,307,375 | 3/1967 | Estrin | 63/15 |
| 4,307,502 | 12/1981 | Scola | 63/15.4 |

FOREIGN PATENT DOCUMENTS

| | | | |
|---|---|---|---|
| 896557 | 5/1944 | France | 63/15.4 |
| 1001782 | 10/1951 | France | 63/15 |

*Primary Examiner*—Peter M. Cuomo
*Assistant Examiner*—Flemming Saether
*Attorney, Agent, or Firm*—Michael G. Marinangeli

[57] ABSTRACT

A hinged insert ring which comprises two precisely crafted ring bodies which are joined together at the bottom of their shanks, which each have two protrusions, with pins thereby creating an operable hinge. The ring bodies are each made of any base metal (e.g. gold, silver, platinum, brass, copper, etc.), and can be formed into any aestetically pleasing design or shape. The hinged double ring can open or close to provide entirely different looks. When the the two precisely crafted ring bodies are in an "open position", a third, independent ring body, with a different design or having a stone or other piece of jewelry attached at its top, can be inserted therebetween and enclosed within the first two ring bodies when they are place in the "closed" position by way of the hinge means. In the closed position, on the other hand, the two precisely crafted ring bodies form a completed ring. This new and unobvious design allows for the wearer to own a single ring yet have an entire line of different looking pieces. This will save money while allowing for a seemingly vast array rings for its wearer.

4 Claims, 2 Drawing Sheets

HINGED INSERT RING

FIELD OF THE INVENTION

This invention generally relates to an article of jewelry worn on the finger. More specifically, but not by way of limitation, the present invention relates to two precisely crafted ring bodies, each made of any base metal (e.g. gold, silver, platinum, brass, copper, etc.), which are joined together at the bottom of the shank with a pin thereby creating a movable hinge. In this way, this herein disclosed hinged double ring can open or close to provide entire different looks. In the closed position, for example, the two precisely crafted ring bodies can form a completed ring; whereas when the two precisely crafted ring bodies are in an "open position", a third, independent ring body, with a different design or having a stone or other piece of jewelry attached at its top, can be inserted between and enclosed within the first two ring bodies when they are place in the "closed" position by way of the hinge means. This new and unobvious disclosure gives birth to the creation of a wholly new line of rings having a unique, versatile look.

DESCRIPTION OF THE PRIOR ART

The use of rings which can be moved about a hinge or which can accept an additional piece of jewelry or ring band are generally known in the art but all have very limiting features which do not make the presently disclosed hinged insert ring obvious. In view of the limitations associated with the prior art, the need for an inexpensive yet functionally rellable hinged insert ring is herein disclosed. The present invention is viewed as providing a new, inexpensive and way to change the look of jewelry, and more particularly, rings that a person can wear.

A prior art search, discloses seven patents dealing with rings were uncovered: U.S. Pat. No. 4,307,502; U.S. Pat. No. 3,307,375; U.S. Pat. No. 2,177,314; U.S. Pat. No. 1,596,642; U.S. Pat. No. 3,307,375; U.S. Pat. No. 211,558; French patent 1,001,782; and French patent 896,557. Although relevant, for various features, none of these prior art patents disclose the overall newly disclosed functional structure, which is of two ring bodies movable about a hinge means which can be worn in a closed position by themselves or which can be opened to accept a third ring body and then closed to envelope said third ring to create a different looking ring having three bands.

The ring shown in Chataigner '782 needs a third ring body 2 whereas in the present invention the ring can be worn without the addition (See FIG. 1 below). In addition, the ring disclosed herein needs a clip lock 6 which is not needed in the present disclosure.

Scola '502 has a single body with a groove 20 in which a ring 10 must be inserted to make a finalized, wearable ring. Except for having this removable ring there are no similarities between this and the present invention.

The "Ornamental Ensemble" in Von Dachenhauser '314 and simply discloses two parallel rings 10 and 11 (see FIG. 7) which must be inverted to accept a third ring 12 between the original loose two parallel rings 10 and 11 (see FIG. 2). The single most distinguishing feature is that there is no hinge connecting the rings at the base.

U.S. Pat. No. 1,596,642 by Weber is dissimilar to the present invention in that it does not disclose two hinged ring bodies which can open to accept a third ring body. Thus, the publication of Weber '642 does not make any references which would have suggested to the person skilled in the art to create a hinged double ring in accordance with the disclosure now made.

Although most similar in having the hinge mechanism, Estrin '375 also requires the input of a stone 26 before it can be worn as a completed ring.

Finally, both Edwards '558 and Nazar '557 simply disclose two identical rings which are attached at some point by either a third tiny ring or a primitive form of a hinge. There is no space or ability to incorporate between said two attached rings any other ring.

SUMMARY OF THE INVENTION

The hinged insert ring according to the present invention comprises two precisely crafted ring bodies which are joined together at the bottom of the shank with a pin thereby creating a movable hinge attached at their shank with an operable hinge means. The ring bodies are each made of any base metal (e.g gold, silver, platinum, brass, copper, etc.), and can be formed into any aestetically pleasing design or shape. The hinged double ring can open or close to provide entire different looks. When the two precisely crafted ring bodies are in an open position, a third, independent ring body, with a different design or having a stone or other piece of jewelry attached at its top, can be inserted between and enclosed within the first two ring bodies when they are place in the closed or adjacent position by way of the hinge means. In the closed position, on the other hand, the two precisely crafted ring bodies can form a completed ring. This new and unobvious design allows for the wearer to own a single ring yet have an entire line of different looking pieces. This will save money for its wearer while allowing for a seemingly vast array rings.

OBJECTS OF THE INVENTION

It is, therefore, the principal object of the present invention to provide a base metal hinged insert ring construction that includes two separate ring bodies attached by movable hinge means so that the two bodies can be adjacently closed to create a two band single ring construction which is functionally worn about a finger and which is aestetically pleasing to the eye.

Another object of the present invention is to provide to provide a base metal hinged insert ring construction that includes two separate ring bodies attached by movable hinge means so the two bodies can be opened to accept a third ring body between them and then closed to create a three band single ring construction which can also be functionally worn about a finger and which has a entirely different look from the two body ring.

Still a further object of the present invention is to provide the above ring construction in a new and relatively inexpensive manner.

Other objects, advantages and novel features of the invention will become readily apparent to those skilled in the art from the following detailed description of the invention when considered in conjunction with the attached drawings wherein like reference numbers identify like parts throughout.

DETAILED DESCRIPTION OF THE INVENTION

Figure 1:
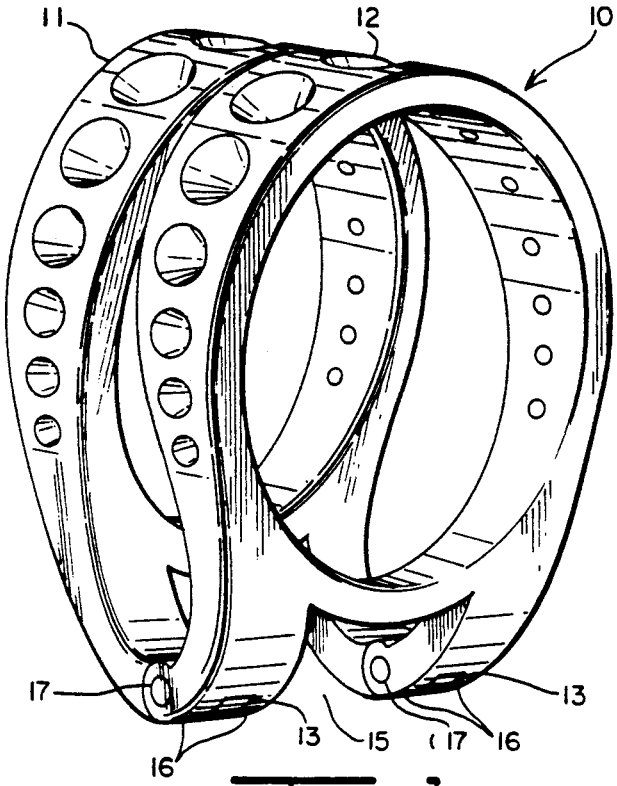
FIG. 1 illustrates an enlarged perspective view of the hinged insert ring, having at the bottom of the shank a hinge means, with the two ring bodies in the "closed" position. It can be worn this way and appear as a completed ring.
Figure 2:
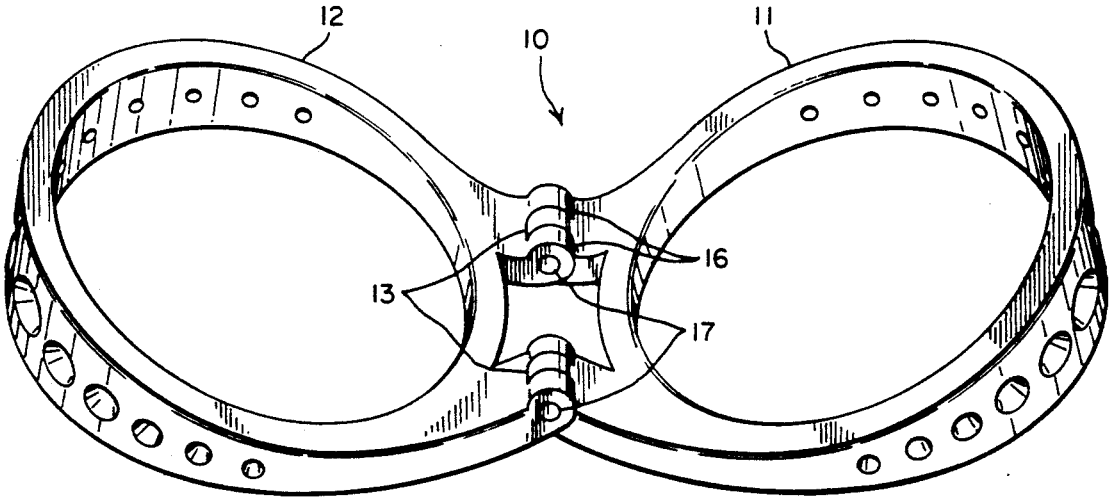
FIG. 2 is an enlarged cross-sectional view of the hinged insert ring of FIG. 1 showing the movement of the two ring bodies, by way of the hinge means, to an "open" position. A third ring body may now be inserted into the opening and the two hinged ring bodies may now be closed around the third ring body as shown in FIG. 3.
Figure 3:
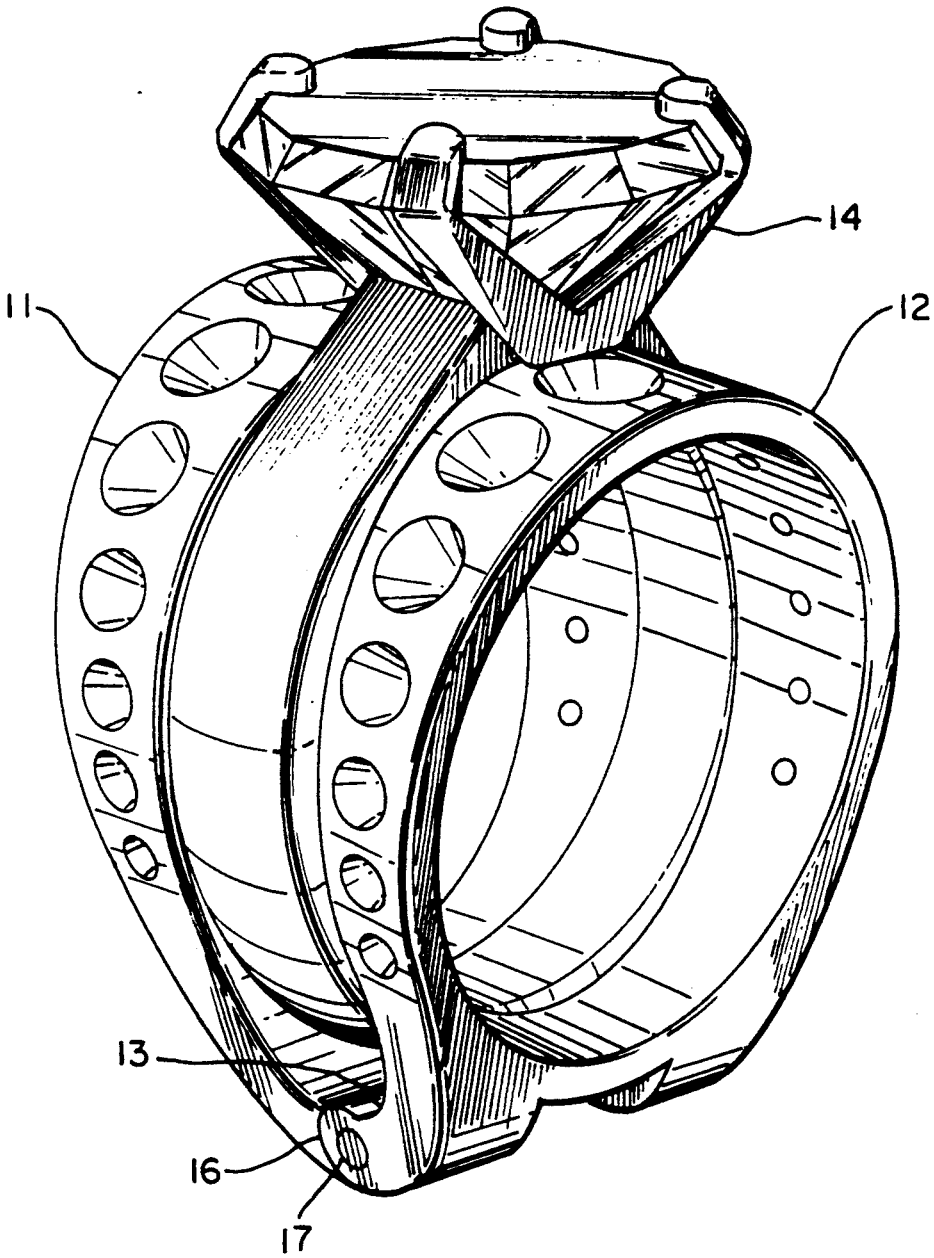
FIG. 3 illustrates an enlarged perspective view of the hinged insert ring in the closed position encircling the third ring body. It appears as one ring.

The features and advantages of using the hinged insert ring 10, according to the present invention, can perhaps be best explained and understood by reference to the drawings. Referring now more specifically to the preferred embodiment shown in FIGS. 1 is disclosed a hinged insert ring 10 comprising two ring bodies 11 and 12. The bottom shank of ring body 11 has two circumferentally spaced single protrusions 13 which are alligned to each other, each having a pin opening, while the bottom shank of ring body 12 has two aligned circumferentally spaced U-shaped protrusions 16 also having pin openings 15, whereby when the two single protrusions 13 are is firmly alligned between the two U-shaped protrusions 16, the two ring bodies 11 and 12 are hingedly connected together by way of two hinge pins 17 inserted thru the pin openings. This allows for the two ring bodies 11 and 12 a movement of articulation about the hinge pins 17, without any movement or slippage of the hinge means. In FIG. 2 the ring bodies 11 and 12 are opened about the hinge pins 17 in order to accept a third ring body 14 between the two ring bodies 11 and 12. While FIG. 1 discloses a the final appearance of the hinged insert ring in closed position with only two ring bodies 11 and 12, FIG. 3 shows a preferred embodiment of a hinged insert ring after a third ring body 14 is inserted therebetween to form a completed ring having three ring bodies 11, 12 and 14 that are radially aligned.

The exact overall cut and size of the three ring bodies 11, 12 and 14 is not limited at their shank top. In addition, exact shape or design or stone (e.g. diamond, sapphire, pearl etc.) placed on top of the third ring body 14 is only limited by the imagination of the wearer. Finally, the three ring bodies 11, 12 and 14 can be made of any base metal such as gold, silver, platinum, brass, copper, and can be mixed and matched also such as making the ring bodies 11 and 12 of silver, but the ring body 14 of gold.

The manufacture of the hinged insert ring 10, according to the present invention, can be by various methods that are generally known in the art to fabricate rings and jewelry.

The advantages and benefits of the present invention are many. For example, the hinged insert ring 10 according to the present invention is relatively inexpensive and highly versatile in that it can be easily used to vary the look of various rings and jewelry.

While a particular use for this hinged insert ring is disclosed for a ring to worn on a finger, the invention disclosed herein can be used for other types of jewelry that it wearer would like to modify its appearance.

Since the invention is described and illustrated with reference to but a single, preferred embodiment, and since numerous modifications and changes will become readily apparent to those skilled in the art after reading this disclosure, it should be understood that I do not wish to limit the scope of my invention to the exact construction shown and described above, and as claimed by me below.

We claim:

1. A hinged insert ring comprising:

a ring body having two single protrusions circumferentally spaced along its bottom shank with a pin opening passing through said protrusions;

a second ring body having two U-shaped protrusion circumferentally spaced along its bottom shank with a pin opening passing through said protrusions;

each of said single protrusions being positioned within one of said U-shaped protrusions such that the pin openings thru the single protrusions of the first ring body being axially alligned with the pin openings of the U-shaped protrusions of the second ring body;

two hinge pins, whereby each of said hinge pins is passed thru one of said single protrusions and each of the U-shaped protrusions to form an operable hinge means; said operable hinge means allows the first and second bodies a stable movement about the hinge pin so that said ring bodies can be closed about the hinge so that each ring body is aligned adjacent to the other and can worn this way to appear as a single completed two band ring.

2. A hinged insert ring as in claim 1 whereby the two ring bodies can be opened about the hinge means so that a third ring body can be inserted between the two ring bodies which are then closed by way of the hinge means so that the three ring bodies are aligned adjacent to each other and can be worn this way to appear as a single completed three band ring.

3. A hinged insert ring of claim 1 wherein the rings are made of any base metal.

4. A hinged insert ring of claim 2 wherein the rings are made of any base metal.

* * * * *